US009745773B2

(12) United States Patent
Halliwell

(10) Patent No.: US 9,745,773 B2
(45) **Date of Patent: *Aug. 29, 2017**

(54) DOUBLE LATCH ASSEMBLY FOR A MOTOR VEHICLE

(71) Applicant: Jaguar Land Rover Limited, Whitley, Coventry (GB)

(72) Inventor: Martin Charles Halliwell, Wheatley (GB)

(73) Assignee: JAGUAR LAND ROVER LIMITED, Whitley, Coventry (GB)

( * ) Notice: Subject to any disclaimer, the term of this patent is extended or adjusted under 35 U.S.C. 154(b) by 203 days.

This patent is subject to a terminal disclaimer.

(21) Appl. No.: 14/314,314

(22) Filed: Jun. 25, 2014

(65) Prior Publication Data

US 2014/0306468 A1 Oct. 16, 2014

Related U.S. Application Data

(60) Continuation of application No. 13/677,806, filed on Nov. 15, 2012, now Pat. No. 8,882,163, which is a division of application No. 12/265,452, filed on Nov. 5, 2008, now Pat. No. 8,336,929.

(51) Int. Cl.

| | |
|---|---|
| ***E05B 15/02*** | (2006.01) |
| ***E05B 83/20*** | (2014.01) |
| ***E05B 85/24*** | (2014.01) |
| ***E05B 81/20*** | (2014.01) |
| ***E05B 81/14*** | (2014.01) |
| *E05B 81/22* | (2014.01) |

(52) U.S. Cl.

CPC ..... *E05B 15/021* (2013.01); *E05B 81/14* (2013.01); *E05B 81/20* (2013.01); *E05B 83/20* (2013.01); *E05B 85/245* (2013.01); *E05B 81/22* (2013.01); *Y10T 292/1047* (2015.04); *Y10T 292/1082* (2015.04); *Y10T 292/696* (2015.04); *Y10T 292/702* (2015.04)

(58) Field of Classification Search

CPC ..... Y10T 24/45293; E05B 85/245; Y10S 292/14; E05C 3/28; E05C 3/34

USPC ..... 292/341.17

See application file for complete search history.

(56) References Cited

U.S. PATENT DOCUMENTS

| | | | |
|---|---|---|---|
| 4,273,368 | A | 6/1981 | Tanaka |
| 4,892,340 | A | 1/1990 | Matumoto |
| 5,035,449 | A | 7/1991 | Shiratori et al. |

(Continued)

FOREIGN PATENT DOCUMENTS

| | | | |
|---|---|---|---|
| DE | 3721962 | A1 | 1/1989 |
| DE | 3734992 | A1 | 5/1989 |

(Continued)

OTHER PUBLICATIONS

GB Search Report for Application No. GB0702126.4 dated Mar. 30, 2007.

(Continued)

*Primary Examiner* — Mark Williams
(74) *Attorney, Agent, or Firm* — Brooks Kushman P.C.

(57) ABSTRACT

A double latch assembly for a motor vehicle having two pivotably mounted closure members is disclosed in which a power cinch mechanism is used to ensure first and second claws are moved and held in a second fully locked position.

14 Claims, 16 Drawing Sheets

(56) References Cited

U.S. PATENT DOCUMENTS

| | | | | |
|---|---|---|---|---|
| 5,688,004 | A * | 11/1997 | Karge | E05B 47/0012 292/201 |
| 6,017,067 | A | 1/2000 | Yoneyama et al. | |
| 6,099,048 | A | 8/2000 | Salmon et al. | |
| 6,694,676 | B2 | 2/2004 | Sakamoto et al. | |
| 8,336,929 | B2 | 12/2012 | Halliwell | |
| 2008/0271503 | A1 | 11/2008 | Buschmann | |

FOREIGN PATENT DOCUMENTS

| | | | |
|---|---|---|---|
| DE | 10007274 | | 9/2000 |
| DE | 10359144 | A1 | 8/2005 |
| DE | 102004011798 | B3 | 10/2005 |
| DE | 102005024588 | A1 | 11/2006 |
| EP | 0721038 | A1 | 7/1996 |
| EP | 1748130 | A2 | 1/2007 |
| GB | 2374116 | A | 10/2002 |
| GB | 2415990 | A | 11/2006 |
| JP | 08-232521 | | 10/1996 |
| WO | 00/00710 | A2 | 1/2000 |
| WO | 2005093195 | A2 | 10/2005 |

OTHER PUBLICATIONS

Search report of corresponding European patent application EP 08200002.7 dated Jul. 2, 2013; 6 pages.
Search report of corresponding Great Britain patent application GB1108813.5; dated Jun. 30, 2011; 2 pages.
Search report of corresponding European patent application EP 08200002.7 dated Oct. 18, 2013; 6 pages.

* cited by examiner

DOUBLE LATCH ASSEMBLY FOR A MOTOR VEHICLE

CROSS-REFERENCE TO RELATED APPLICATIONS

This application is a continuation of U.S. application Ser. No. 13/677,806 filed Nov. 15, 2012 now issued U.S. Pat. No. 8,882,163 which is a division of Ser. No. 12/265,452 filed Nov. 5, 2008, now issued U.S. Pat. No. 8,336,929 the disclosures of which are incorporated in their entirety by reference herein.

BACKGROUND

This invention relates to the latching of vehicle closure members such as doors and tailgates and in particular to the latching of a pair of doors or tailgates.

It is known from to provide a motor vehicle door lock arrangement for a double rear hatch having a lower closure member in the form of a hatch door or tailgate which can be swung down and an upper closure member in the form of a hatch door or tailgate which can be folded up. Door lock mechanisms are mounted on each side edge of a body opening and closure blocks mounted on side edges of the hatch doors cooperate with the door lock mechanisms. The lock mechanisms for the lower hatch and the upper hatch are combined into a single lock unit mounted on a lock carrier at each side of the body opening.

Although this arrangement is preferable to an arrangement in which two separate lock units have to be mounted on each side of the body opening it has the disadvantage that to ensure the correct sequencing of the opening of the hatches a microswitch has to be used to prevent the lower hatch from being unlocked before the upper hatch has opened.

SUMMARY

The double latch assembly of the present invention provides a double latching device for two opposing closures such as an upper and lower tailgate. Preferably, the double latch assembly has first and second rotatable claws to hold the closure members in a latched position. Additionally, the double latch assembly has two pawls, a disengagable coupling and a sequencing lever to selectively hold and release the closure members. When actuated, the two pawls, disengagable coupling and sequencing lever cooperate to release the claws and in turn release the closure members in a predetermined order. Upon closing, the double latch assembly also ensures re-latching of the closures in the correct sequence.

A further aspect of the present invention provides for a power cinching mechanism in order to provide a better seal between the two closures by drawing the closures into a fully closed position. In one embodiment, the cinching mechanism is comprised of a slideable mounting plate to which the claws, pawls, sequencing lever and disengagable couple attach. When actuated, the plate slides to cinch the seal between the two closures. In an alternate embodiment, the power cinching mechanism is a drive wheel and drive mechanism that effect rotation of the claws to cinch the closures into a fully closed position.

BRIEF DESCRIPTION OF THE DRAWINGS

The invention will now be described by way of example with reference to the accompanying drawings of which.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
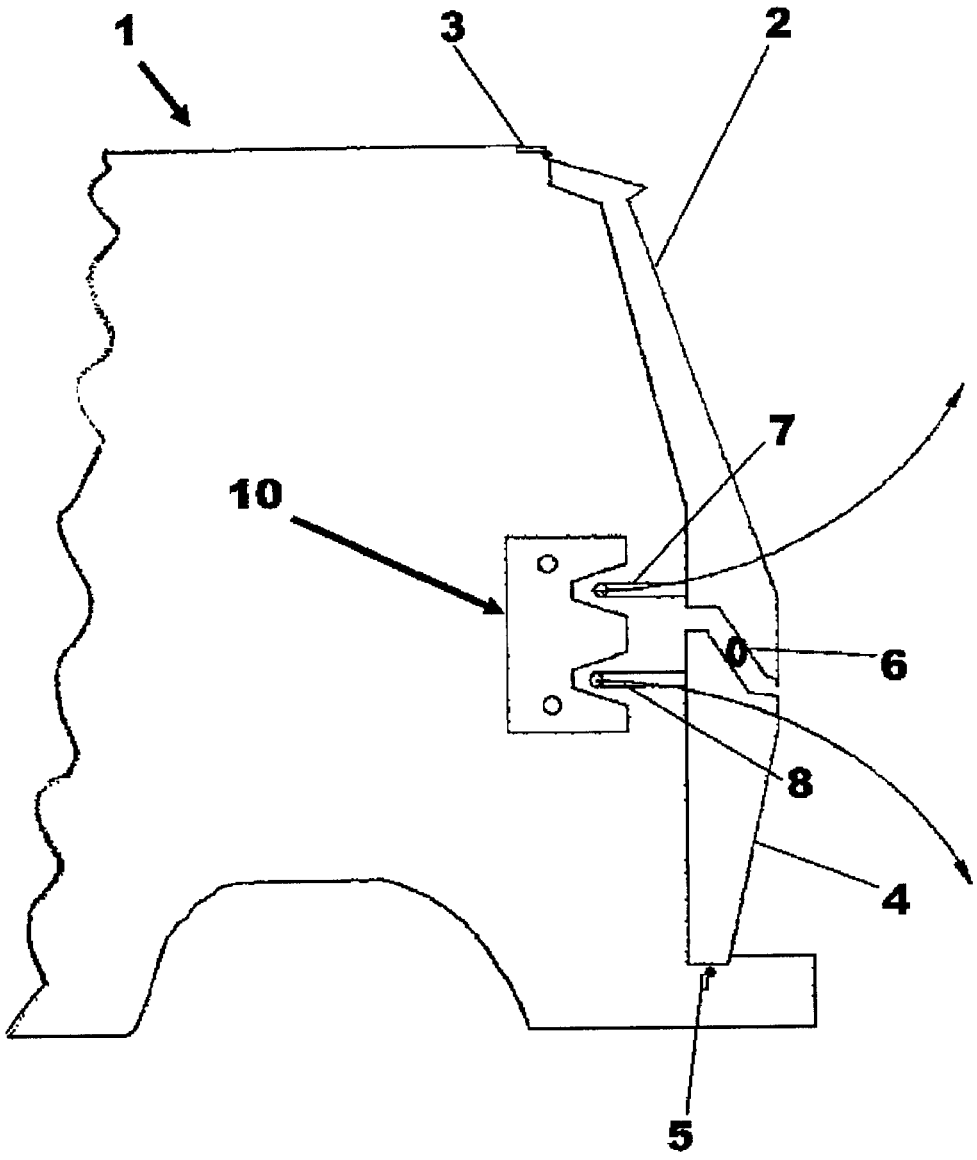
FIG. 1 is a schematic view of a rear end of a motor vehicle having two pivotably mounted closure members and a double latch assembly in accordance with the invention.

With reference to FIG. 1 there is shown a rear end of a vehicle 1 having a first closure member in the form of an upper hatch or tailgate 2 pivotally connected to a body structure of the vehicle 1 for rotation about a substantially horizontally arranged pivot axis by a pair of hinges of which only a right-hand side hinge 3 is shown and a second closure member in the form of a lower hatch or tailgate 4 pivotally connected to the body structure of the vehicle 1 for rotation about a pivot axis arranged parallel to the pivot axis of the upper tailgate by a pair of hinges of which only a right-hand side hinge 5 is shown.

A number of seals represented by the seal 6 are located between the two tailgates 2, 4 and the body structure (not shown) and between the two tailgates 2, 4 as shown. These seals prevent the ingress of dust and water into the interior of the motor vehicle 1 when the two tailgates 2, 4 are fully closed and also prevent rattling by acting as buffers for the two tailgates 2, 4.

A pair of first latch members are fastened to the upper tailgate 2 of which only a right-hand side striker 7 is shown and a pair of second latch members are fastened to the lower tailgate of which only a right-hand side striker 8 is shown. The strikers 7, 8 are arranged for engagement with a double latch assembly 10 fastened in this case to the right-hand side of the body structure of the motor vehicle 1. It will be appreciated that a second double latch mechanism of the same construction is fastened to the left-hand side of the body structure of the motor vehicle 1 for cooperation with strikers (not shown) fastened to the left-hand side of the upper and lower tailgates 2, 4.

Referring now to FIGS. 2 to 5 there is shown a first embodiment of the double latch assembly 10 shown on FIG. 1.

The right-hand side double latch assembly 10 comprises of a backplate 11 which is secured to the body structure by fixings not shown. The backplate 11 has two V-shaped recesses 12, 13 formed on one edge to act as guides for the strikers 7, 8 when the upper and lower tailgates 2, 4 are moved from an open condition towards a latched condition.

A first rotatable claw 14 is rotatably supported on the backplate 11 by means of a pivot pin 15. The first claw 14 has a V-shaped notch 7*a* for cooperation with the striker 7 of the upper tailgate 2, a first abutment surface 16 formed by a first step in the outer circumference of the first claw 14 and a second abutment surface 17 formed by a second step in the outer circumference of the first claw 14. The first claw 14 is biased into an open position by a torsion spring (not shown) that is to say, as shown the claw 14 is biased in a clockwise direction by the spring.

A first pawl 18 is rotatably mounted on the backplate 11 by means of a pivot pin 19. A spring 20 is used to bias the pawl 18 for engagement with the first claw 14 and, in particular, for engagement with the first abutment surface 16 on the first claw 14 so as to hold the first claw 14 in a first position corresponding to a latched position of the upper tailgate 2.

A second rotatable claw 24 is rotatably mounted on the backplate 11 by means of a pivot pin 25. The second claw 24 has a V-shaped notch 8*a* for cooperation with the striker 8 of the lower tailgate 4. A number of abutment surfaces are formed by steps in the outer circumference of the second claw 24 these include a first abutment surface (not shown) and a second abutment surface 26. The second claw 24 is biased into an open position by a torsion spring (not shown) that is to say, as shown the claw 24 is biased in an anti-clockwise direction by the spring.

A second pawl 27 is rotatably mounted on the backplate 11 by means of a pivot pin 28 and a spring (not shown) is used to bias the pawl 27 for engagement with the second claw 24 and, in particular, for engagement with the first abutment surface (not shown) on the second claw 24 so as to hold the second claw 24 in a first position corresponding to the latched position of the lower tailgate 4. A coupling pin 29 is attached to the second pawl 27 near to an opposite end of the pawl 27 to where it is pivotably supported by the pivot pin 28. A longitudinal axis of the second pawl 27 passes through the coupling pin 29 and the pivot pin 28.

A sequencing lever 30 is rotatably mounted on the backplate 11 by means of a pivot pin 34 for selectively releasing the first and second pawls 18, 27. The pivot pin 34 is located in an elongate slot 33 near to one end of the sequencing lever 30 and an actuating surface 31 is formed at an opposite end of the sequencing lever 30 for abutment against the first pawl 18. A drive surface 32 defined by a step in the periphery of the sequencing lever 30 is formed on one edge of the sequencing lever 30 and a guide in the form of an L-shaped slot 35 is formed in the sequencing lever 30 for cooperation with the coupling pin 29 attached to the second pawl 27.

A spring 36 (shown only on FIG. 2) is used to bias the sequencing lever 30 into a resting position in which it is not reacting against the first pawl 18. That is to say, as shown, the spring 36 biases the sequencing lever 30 in an anti-clockwise direction for engagement with a single actuator. The single actuator is not shown in detail but is graphically represented by the arrow A1 corresponding to the direction in which force is applied by the actuator to the sequencing lever 30.

The actuator A1 can be of any suitable type such as, for example and without limitation, an electrical actuator, a pneumatic actuator or a hydraulic actuator.

The L-shaped slot 35 forms in combination with the coupling pin 29 a disengageable coupling between the sequencing lever 30 and the second pawl 27. The disengageable coupling enables the sequencing lever 30 to control the unlatching of the upper and lower tailgates 2 and 4 to ensure that the upper tailgate 2 is always unlatched and opened before the lower tailgate 4 can be unlatched.

A first arm of the L-shaped slot 35 forms a guide for the coupling pin 29 in which any rotation of the sequencing lever 30 will result in a consequential rotation of the second pawl 27 and a second arm of the L-shaped slot 35 is arranged substantially perpendicular to the first arm such that any movement of the sequencing lever 30 when the coupling pin 29 is engaged in the second arm will cause no rotation of the second pawl 27. The guide formed by the first arm extends along an axis arranged substantially parallel to the longitudinal axis of the second pawl 27 when the sequencing lever 30 is in its resting position.

Figure 2:
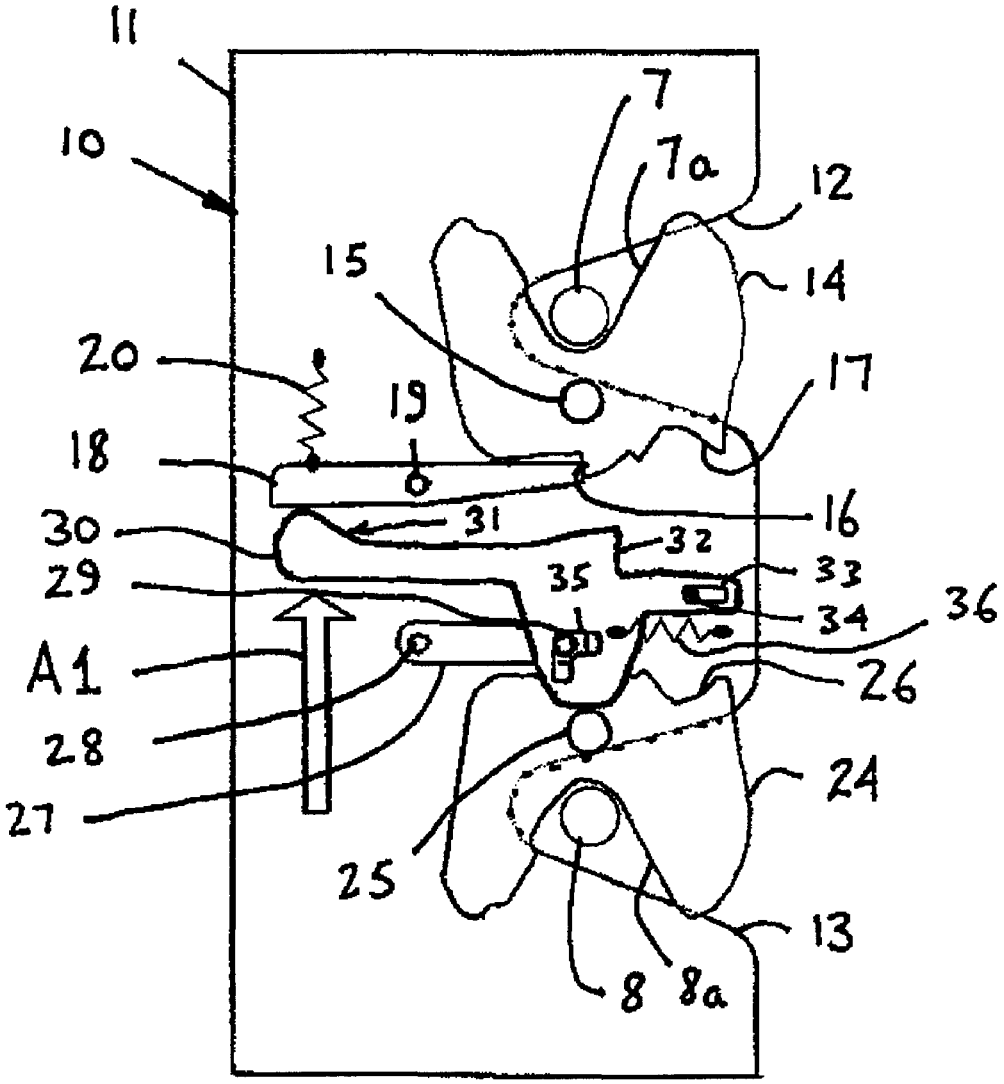
FIG. 2 is a plan view of a first embodiment of a double latch assembly according to the invention showing first and second rotary claws in first or latched position, first and second pawls, a sequencing lever and a disengageable coupling.
Figure 14:
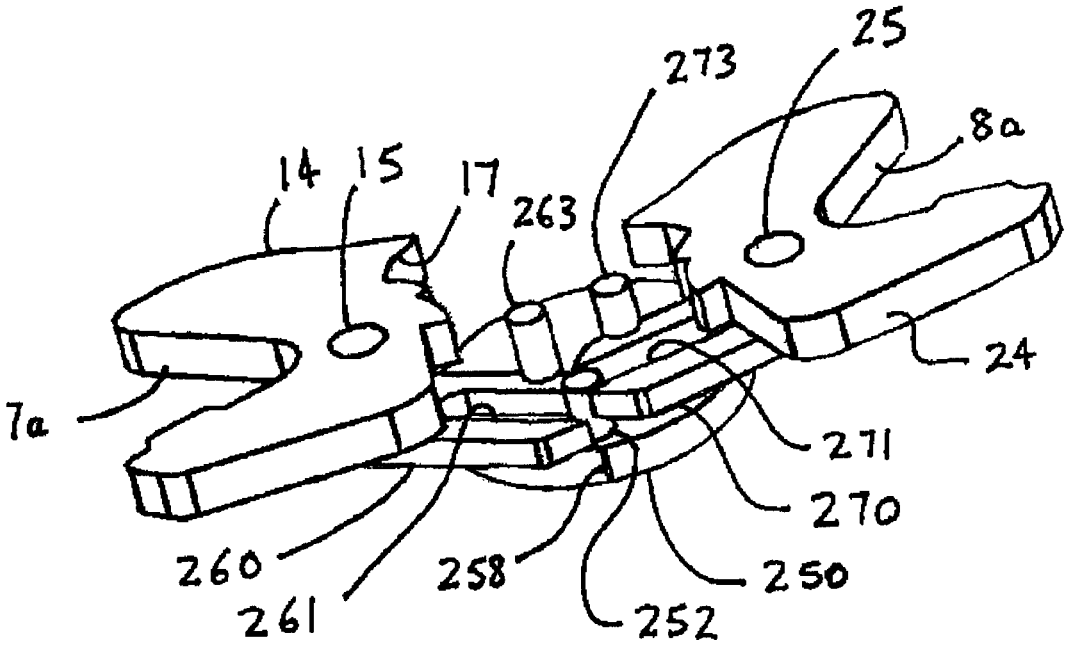
FIG. 14 is a scrap perspective view showing the cinch mechanism of FIG. 13.

Operation of the double latch assembly 10 from the latched position shown in FIG. 2 is as follows.

Figure 3:
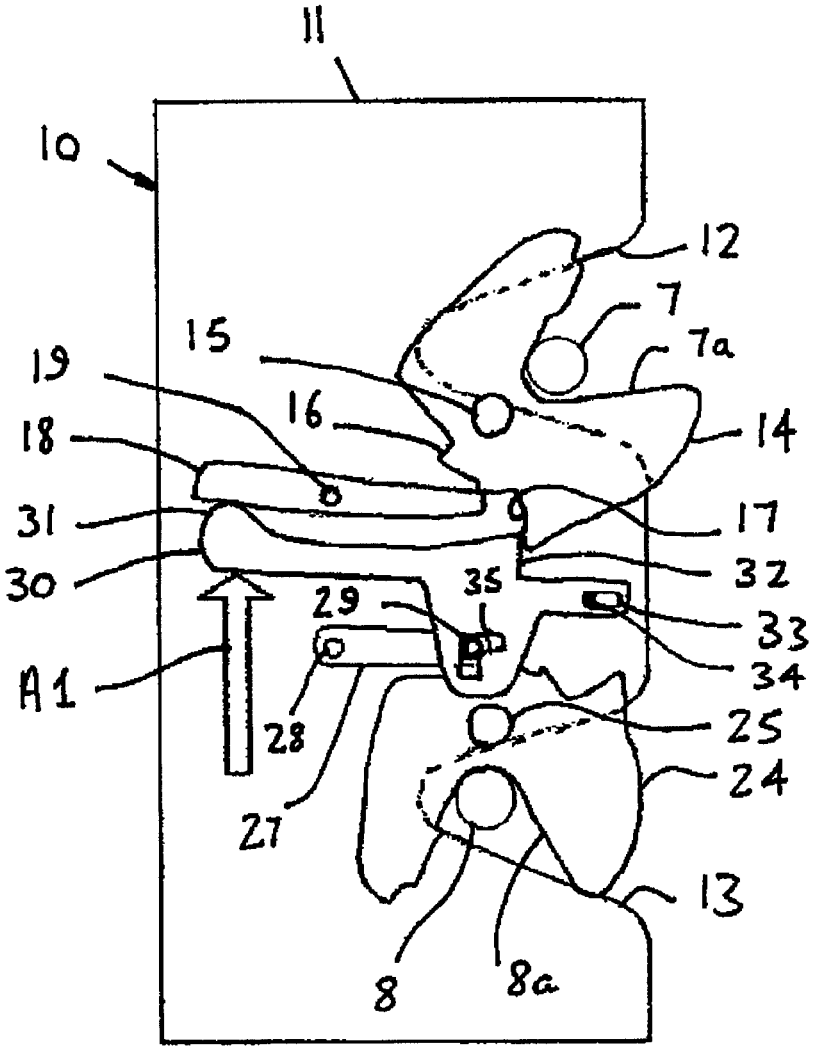
FIG. 3 is a view similar to FIG. 2 but showing the first pawl disengaged from the first claw thereby allowing the first pawl to rotate away from the first or latched position towards an open position.

When the actuator A1 is actuated by a driver operable device such as a release lever or remote handset it provides an actuation pulse to the sequencing lever 30 which causes the sequencing lever 30 to rotate into contact with the first pawl 18, thereby moving the first pawl 18 out of contact with the first abutment surface 16. The first claw 14 is then free to move under the action of the torsion spring from its first position corresponding to a latched position of the upper tailgate 2 to an unlatched position as shown in FIG. 3. In this unlatched position the second abutment surface 17 rests against the drive surface 32 on the sequencing lever 30 but the force exerted by the first claw 14 on the sequencing lever 30 is insufficient to displace the sequencing lever 30. After the pulse from the actuator A1 has terminated, the sequencing lever 30 returns to its resting position due to the action of the spring 36.

Figure 4:
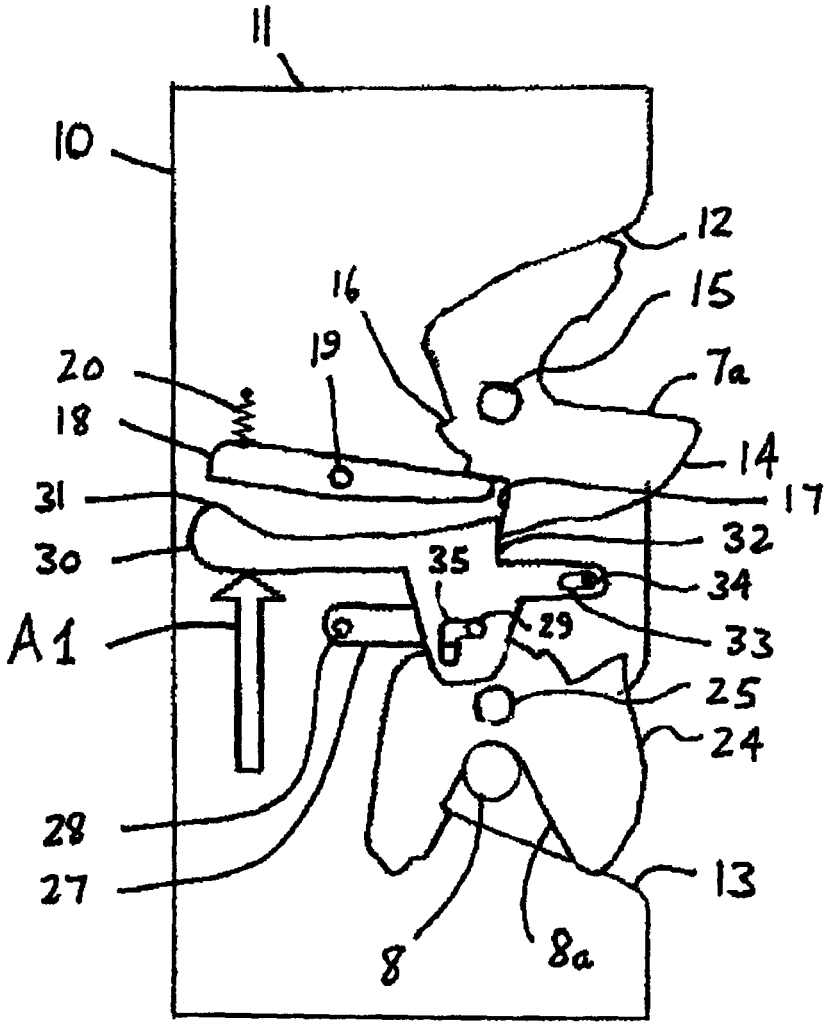
FIG. 4 is a view similar to FIG. 3 but showing the first claw in an open position in which it has displaced the sequencing lever so as to engage the disengageable coupling.

When the upper tailgate 2 is opened further by either manual or power means the first claw 14 is rotated further from its unlatched position by the action of the striker 7 against the V-shaped notch 7*a*. This further rotation of the first claw 14 causes the first claw 14 to move or displace the sequencing lever 30 due to the interaction of the second abutment surface 17 with the drive surface 32 on the sequencing lever 30. As shown in FIG. 4, as the sequencing lever 30 is displaced the pivot pin 34 slides along to an opposite end of the slot 33 and the coupling pin 29 engages with the guide formed by the first arm of the L-shaped slot 35. This engagement of the coupling pin 29 with the first arm engages the disengageable coupling between the sequencing lever 30 and the second pawl 27.

Figure 5:
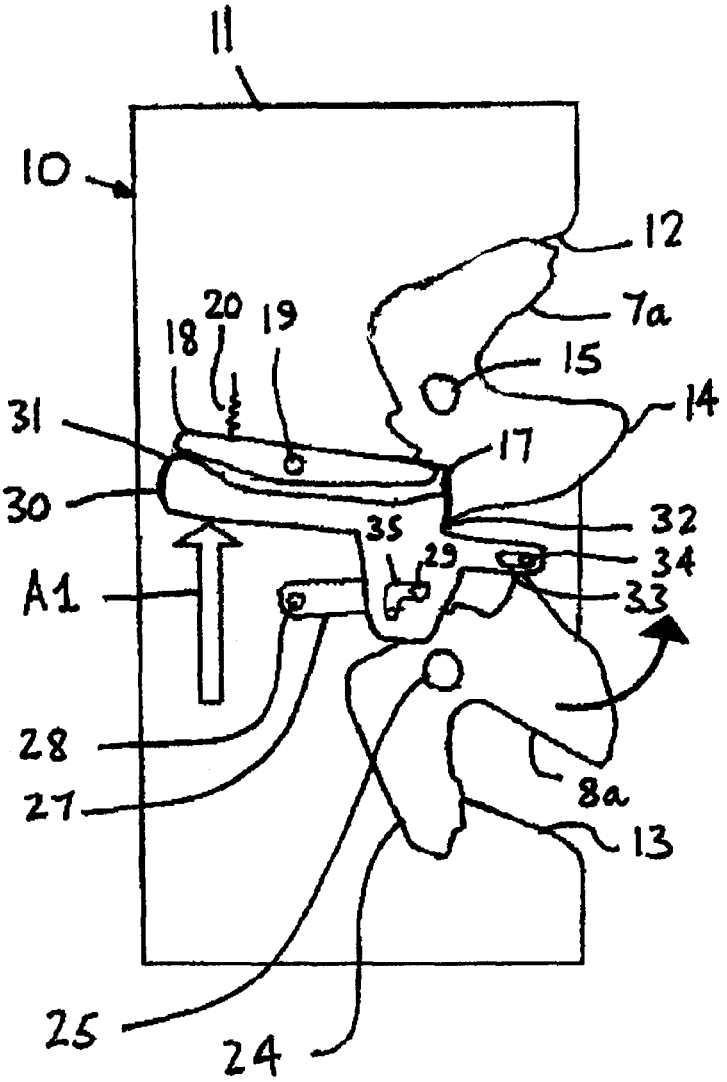
FIG. 5 is a view similar to FIG. 4 but showing the location of the claws, the pawls, the sequencing lever and the disengageable coupling after the second pawl has been released by the sequencing lever so as to allow the second claw to rotate towards an open position.

When the actuator A1 is now pulsed for a second time the sequencing lever 30 is rotated as before but now the disengageable coupling is engaged and so the second pawl 27 is released from its engagement with the first surface on the second claw 24. The second claw 24 is then free to move under the action of the torsion spring from its first position corresponding to a latched position of the lower tailgate 4 to an unlatched position as shown in FIG. 5

Therefore in summary, when the disengageable coupling is disengaged, the rotation of the sequencing lever 30 by the actuator A1 causes only the first pawl 18 to be disengaged but, when the disengageable coupling is engaged, the rotation of the sequencing lever 30 causes the second pawl 27 to be rotated out of engagement with the second claw 24. It will be appreciated that the first pawl 18 is also rotated but this is of no significance as it has already been disengaged from the first claw 14

Figure 2A:
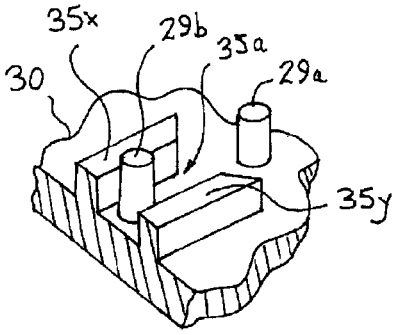
FIG. 2A is a scrap view showing an alternative form of disengageable coupling for use in the first embodiment.

FIG. 2A shows an alternative construction of disengageable coupling to that previously described. Instead of the coupling pin 29 being engageable with first or second arms of an L-shaped slot 35 it is engageable with a guide 35*a* formed by a pair of elongate ribs 35*x*, 35*y* formed on a surface of the sequencing lever 30. When the coupling pin 29 is not engaged with the guide 35*a* as indicated by the reference numeral 29*a* the disengageable coupling is disengaged and when the coupling pin 29 is engaged with the guide 35*a* as indicated by the reference numeral 29*b* the disengageable coupling is engaged.

When the tailgates 2, 4 are to be closed it is required that the lower tailgate 4 be latched before the upper tailgate 2 is latched. To achieve this aim, the second pawl 27 rests upon an abutment surface on the second claw 24 when the lower tailgate 4 is unlatched. The engagement of the second pawl 27 with the second claw 24 is such that it urges the sequencing lever 30 into contact with the first pawl 18 preventing the first pawl 18 from re-engaging with the first claw 14 while the lower tailgate 4 is open. This ensures that the upper tailgate 2 cannot be latched until the lower tailgate 4 has been moved to its latched position. When the lower tailgate 4 is latched the second pawl 27 re-engages with the first surface on the second claw 24 and in this position the second pawl 27 can no longer urge the sequencing lever 30 against the first pawl 18. The upper tailgate 2 can then be latched by re-engaging the first pawl 18 with the first abutment surface 16 on the first claw 14.

With reference to FIGS. 6 to 9 there is shown a second embodiment of a double latch assembly according to the invention. The double latch assembly is much as before and so the same reference numerals are used for similar components and so will not be described again in detail.

In this second embodiment instead of a sequencing lever 30 having a slot 35, the double latch assembly comprises a sequencing lever 50 which is rotatably mounted on the backplate 11 by means of a pivot pin 52 for selectively releasing the first and second pawls 18, 27. The pivot pin 52 is located near to one end of the sequencing lever 50 and an actuating surface 51 is formed at an opposite end of the sequencing lever 50 for abutment against the first pawl 18. A spring (not shown) is used to bias the sequencing lever 50 into a resting position in which it is not reacting against the first pawl 18. That is to say, as shown, the spring biases the sequencing lever 50 in an anti-clockwise direction for engagement with a single actuator.

A drive lever 60 is further pivotally connected to the sequencing lever 50 by means of a pivot pin 53. The drive lever 60 has a step formed in one edge defining a drive surface 61. A spring 63 (shown only on FIG. 8) is used to bias the drive lever 60 in a preferred direction.

Figure 6:
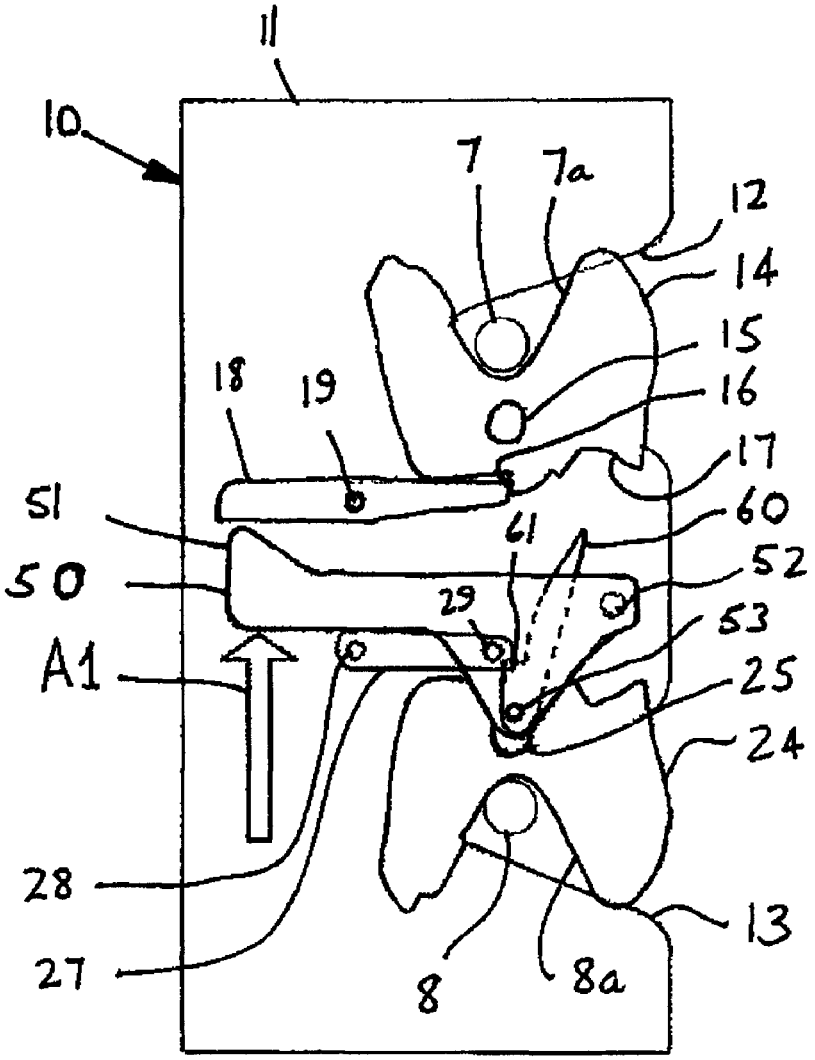
FIG. 6 is a view similar to that shown in FIG. 2 but showing a second embodiment of double latch assembly according to the invention.

Operation of the double latch assembly 10 from the latched position shown in FIG. 6 is as follows.

Figure 7:
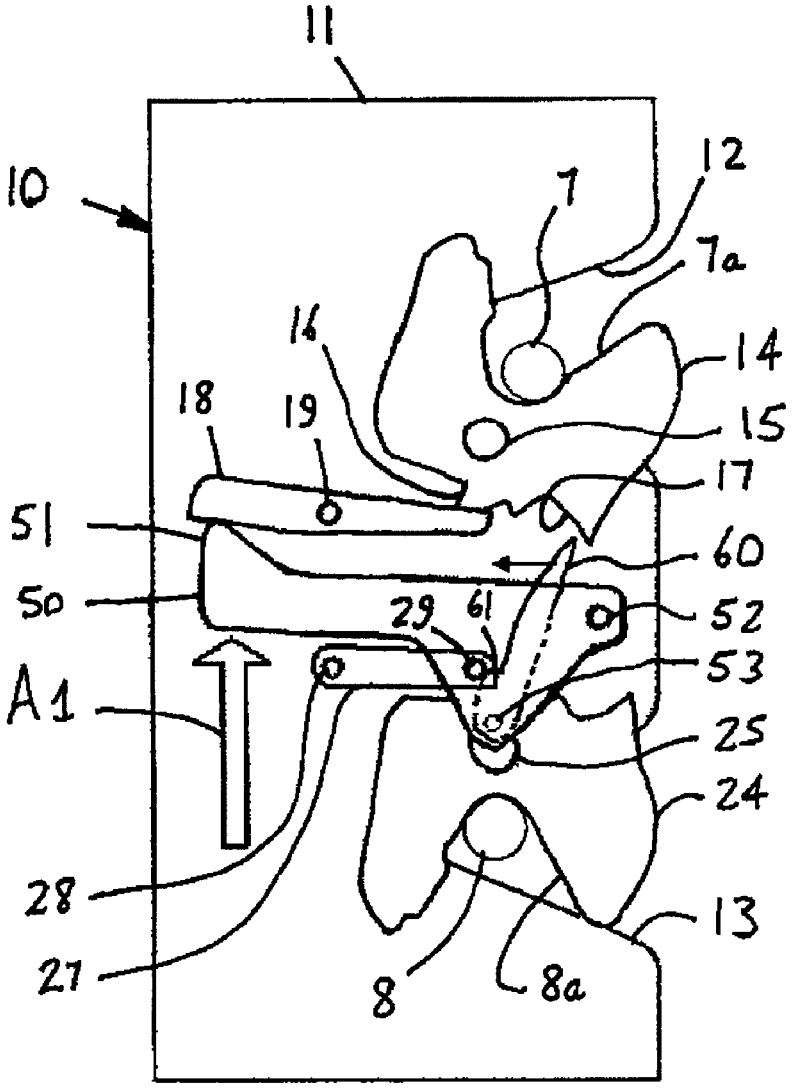
FIG. 7 is a view similar to FIG. 6 but showing a first pawl disengaged from a first claw thereby allowing the first claw to rotate away from a first or latched position towards an open position.

When the actuator A1 is actuated by a driver operable device such as a release lever or remote handset it provides an actuation pulse to the sequencing lever 50 which causes the sequencing lever 50 to rotate into contact with the first pawl 18 thereby moving the first pawl 18 out of contact with the first abutment surface 16. The first claw 14 is then free to move under the action of the torsion spring from its first position corresponding to a latched position of the upper tailgate 2 to an unlatched position as shown in FIG. 7. In this unlatched position the second abutment surface 17 is located close to or rests against an upper end of the drive lever 60 located at the opposite end to where it is pivotally supported by the pivot pin 53 on the sequencing lever 50. After the pulse from the actuator A1 has terminated, the sequencing lever 50 returns to its resting position due to the action of a return spring (not shown).

Figure 8:
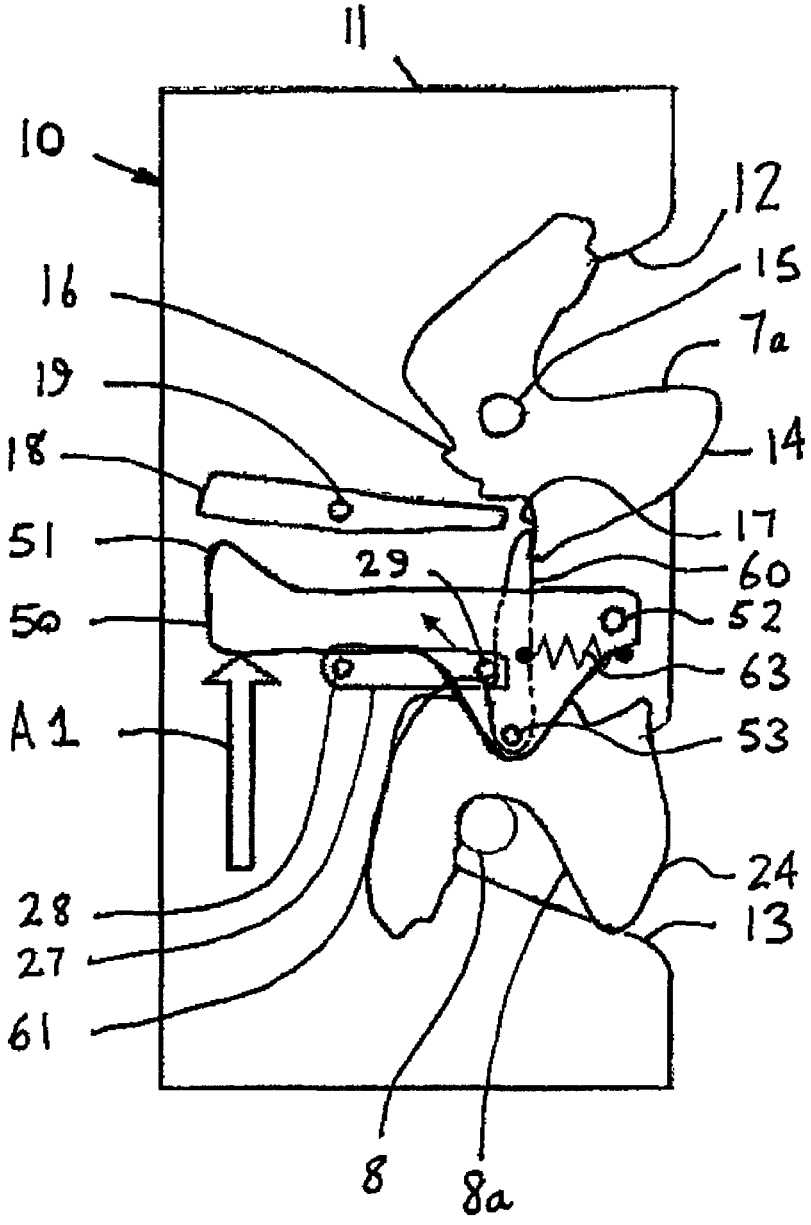
FIG. 8 is a view similar to FIG. 7 but showing the first claw in an open position in which it has displaced a drive lever attached to the sequencing lever so as to engage the disengageable coupling.

When the upper tailgate 2 is opened further by either manual or power means the first claw 14 is rotated further from its unlatched position by the action of the striker 7 against the V-shaped notch 7*a*. This further rotation of the first claw 14 causes the first claw 14 to rotate or displace the drive lever 60 due to the interaction of the second abutment surface 17 with the upper end of the drive lever 60. As shown in FIG. 8, the displacement of the drive lever 60 causes the coupling pin 29 to engage with the drive surface 61 on the drive lever 60 thereby engaging a disengageable coupling between the sequencing lever 50 and the second pawl 27.

Figure 9:
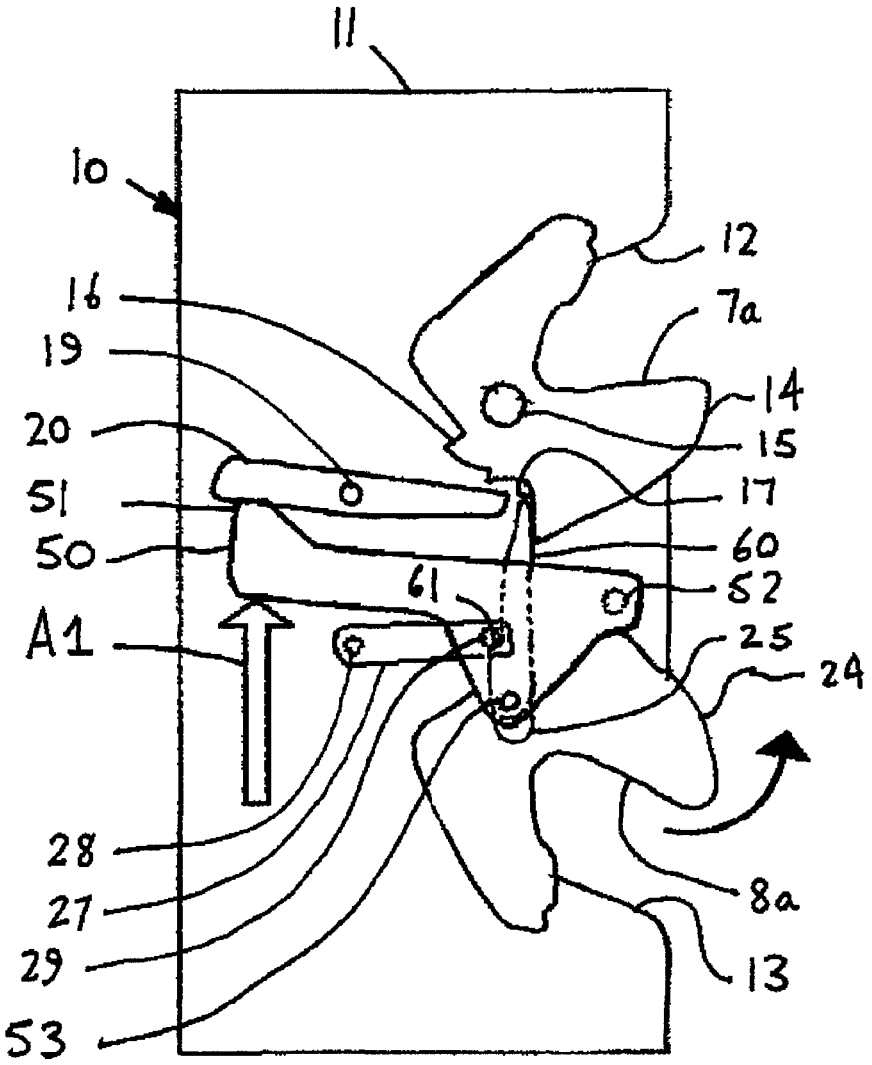
FIG. 9 is a view similar to FIG. 7 but showing the location of the claws, the pawls, the driver lever, the sequencing lever and the disengageable coupling after a second pawl has been released by the sequencing lever so as to allow a second claw to rotate towards an open position.

When the actuator A1 is now pulsed for a second time the sequencing lever 50 is rotated as before but now the disengageable coupling is engaged and so the second pawl 27 is released from its engagement with the first surface on the second claw 24. The second claw 24 is then free to move under the action of the torsion spring from its first position corresponding to a latched position of the lower tailgate 4 to an unlatched position as shown in FIG. 9

As before, when the tailgates 2, 4 are to be closed, the second pawl 27 rests upon an abutment surface on the second claw 24 when the lower tailgate 4 is unlatched and this engagement urges the sequencing lever 50 into contact with the first pawl 18 preventing the first pawl 18 from re-engaging with the first claw 14 while the lower tailgate 4 is open. When the lower tailgate 4 is latched the second pawl 27 re-engages with the first surface on the second claw 24 and in this position the second pawl 27 can no longer urge the sequencing lever 50 against the first pawl 18. The upper tailgate 2 can then be latched by re-engaging the first pawl 18 with the first abutment surface 16 on the first claw 14.

Figure 10:
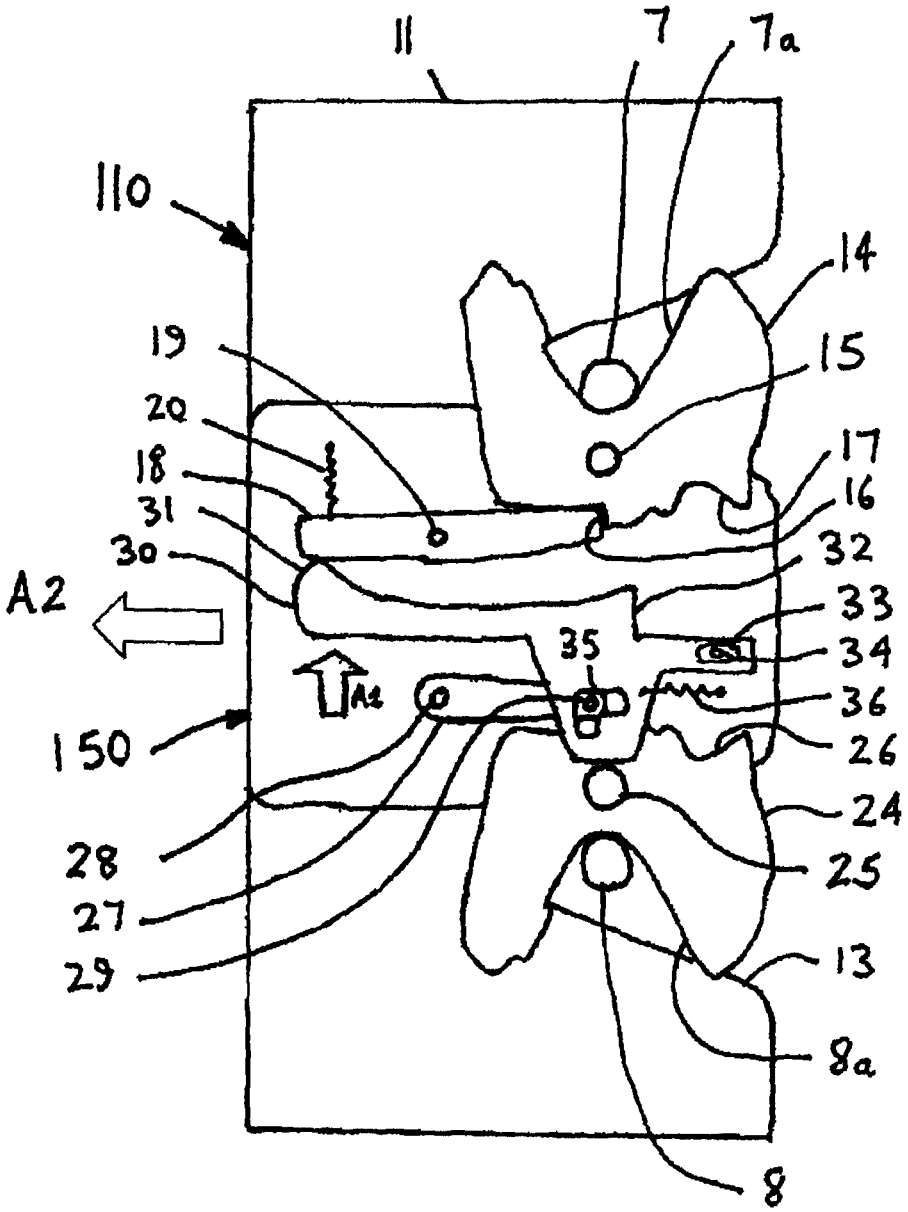
FIG. 10 is a plan view of a first embodiment of a power cinch mechanism that is suitable for use with a double latching assembly according to the invention showing the power cinch mechanism in a non-cinched position.
Figure 11:
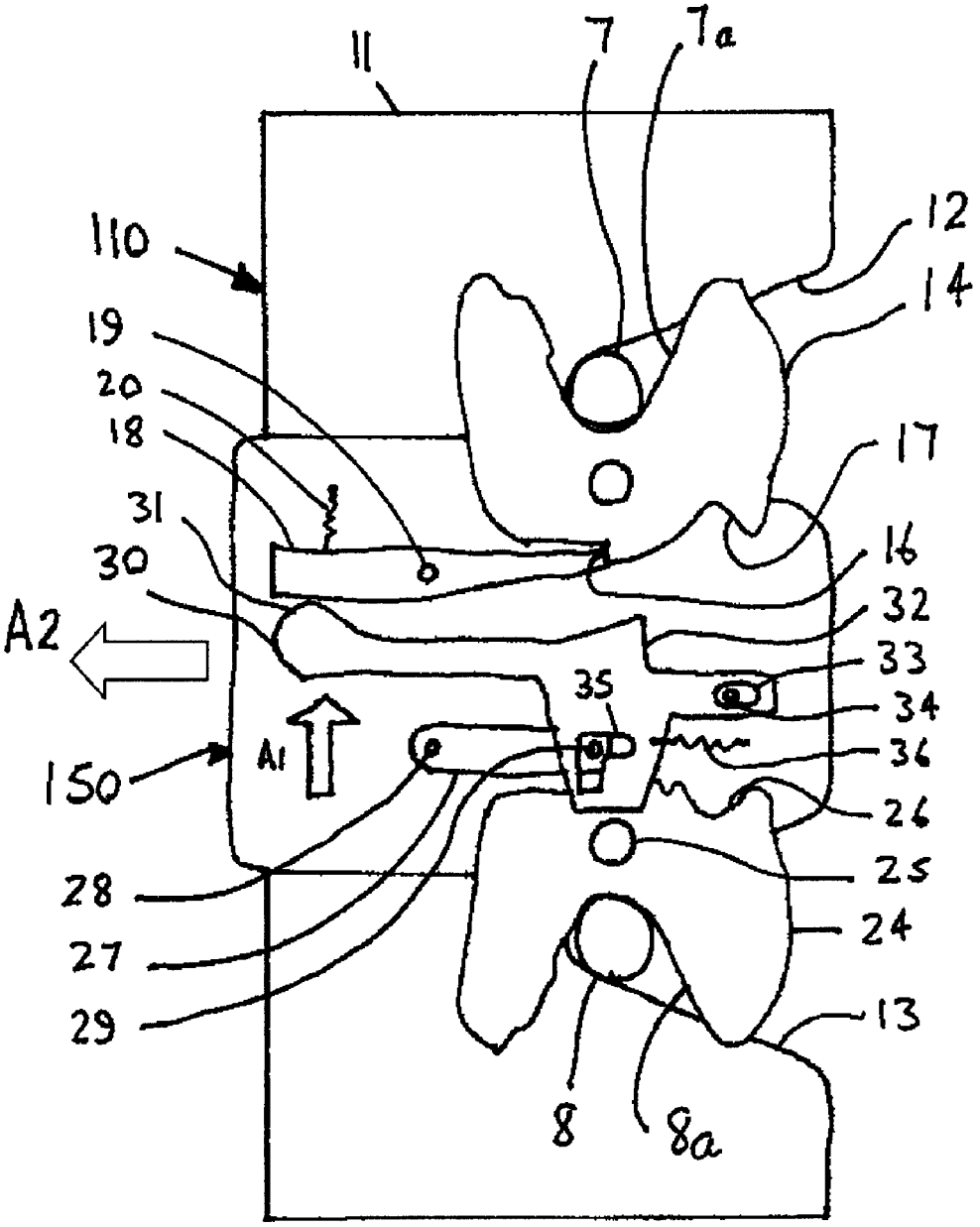
FIG. 11 is a view similar to FIG. 10 but showing the power cinch mechanism in a cinched position.
Figure 12:
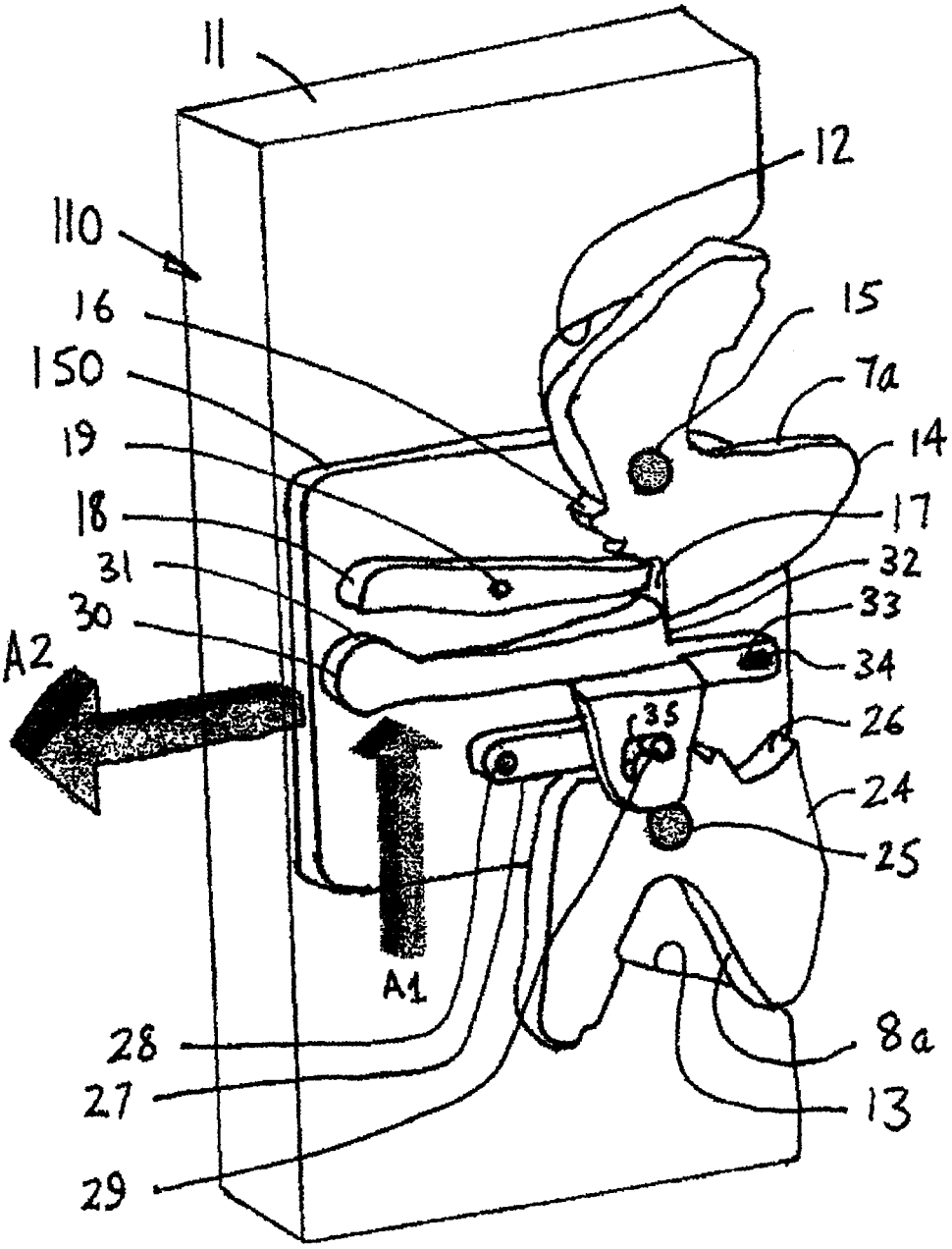
FIG. 12 is a perspective view corresponding to FIG. 10.

With reference to FIGS. 10 to 12 there is shown a first embodiment of a power cinch mechanism that can be incorporated as part of a double latch assembly as previously described or can be used with other forms of double latch assembly.

The power cinch mechanism 110 comprises of a single actuator which is not shown in detail but is graphically represented by the arrow A2 corresponding to the direction in which force is applied by the actuator and a slideable plate 150 upon which is mounted a double latch assembly.

The actuator A2 can be of any suitable type such as, for example and without limitation, an electrical actuator, a pneumatic actuator or a hydraulic actuator.

As shown in FIGS. 10 to 12 the double latch mechanism is identical to that previously described with reference to FIGS. 2, 3, 4 and 5 and so will not be described again in detail.

The single actuator A2 is attached to the slideable mounting plate 150 which is slidingly supported on a backplate such as the backplate 11 previously referred to.

The first rotatable claw 14, the first pawl 18, the second rotatable claw 24, the second pawl 27 and the sequencing lever 30 are rotatably mounted on the mounting plate 150.

In FIGS. 10 and 12 the slideable mounting plate 150 is shown in an un-cinched position corresponding to the latched position previously referred to which respect to FIGS. 2, 3, 4 and 5. In the un-cinched position the upper and lower tailgates are latched closed but the seals 6 are not fully compressed. This position is often referred to as a safety latch position.

In order to compress the seals 6 and move the upper and lower tailgates to their fully closed or cinched positions the actuator A2 is energised causing it to slide the mounting plate relative to the backplate 11. This action pulls the strikers 7 and 8 fully into the V-shaped recesses 12, 13 as indicated on FIG. 11. A detent mechanism (not shown) is used to hold the mounting plate 150 in the cinched position so that the actuator A2 does not need to be continuously powered. The detent mechanism may comprise of a pin attached to a rear side of the first pawl 18 that extends through an aperture on the mounting plate 150 and engages with a step formed in the backplate 11. When the first pawl 18 is moved to release the first claw 14 the pin attached to it firstly disengages from the step allowing the mounting plate 150 to move back to the un-cinched position shown in FIGS. 10 and 12. It will however be appreciated that other detent mechanisms could be used. The mounting plate 150 is biased by a spring (not shown) towards the un-cinched position.

In a modification the line of action of the actuator A2 is such that it pulls one striker and then the other one so as to sequence the closure.

With reference to FIGS. 13 to 16 there is shown a second embodiment of a power cinch mechanism that can be incorporated as part of a double latch assembly as previously described or can be used with other forms of double latch assembly.

The power cinch mechanism 210 comprises of a drive wheel 250 having a number of teeth 258 formed around its outer periphery drivingly connected by means of a gear wheel 251 to a single actuator (not shown) and two drive mechanisms driven by the drive wheel 250 to effect rotation of the first and second pawls 14, 24 from their first positions to second positions corresponding to the fully closed positions of the upper and lower tailgates 2, 4.

The two drive mechanisms comprise a first arm 260 having a longitudinal slot 261 formed therein driveably connected to the first claw 14, a second arm 270 having a longitudinal slot 271 formed therein driveably connected to the second claw 24 and a drive pin 252 fastened to the drive wheel 250 for engagement with the respective slots 261, 271 in the first and second arms 260 and 270 such that rotation of the drive wheel 250 in a clockwise direction will cause the first arm 260 to rotate the first claw 14 to its second position and rotation of the drive wheel 250 in an anticlockwise direction will cause the second arm 270 to rotate the second claw 24 to its second position.

The first arm 260 is fastened to the pivot pin 15 upon which the first claw 14 is rotatably mounted and the second arm 270 is fastened to the pivot pin 25 upon which the second claw 24 is rotatably mounted.

Figure 13:
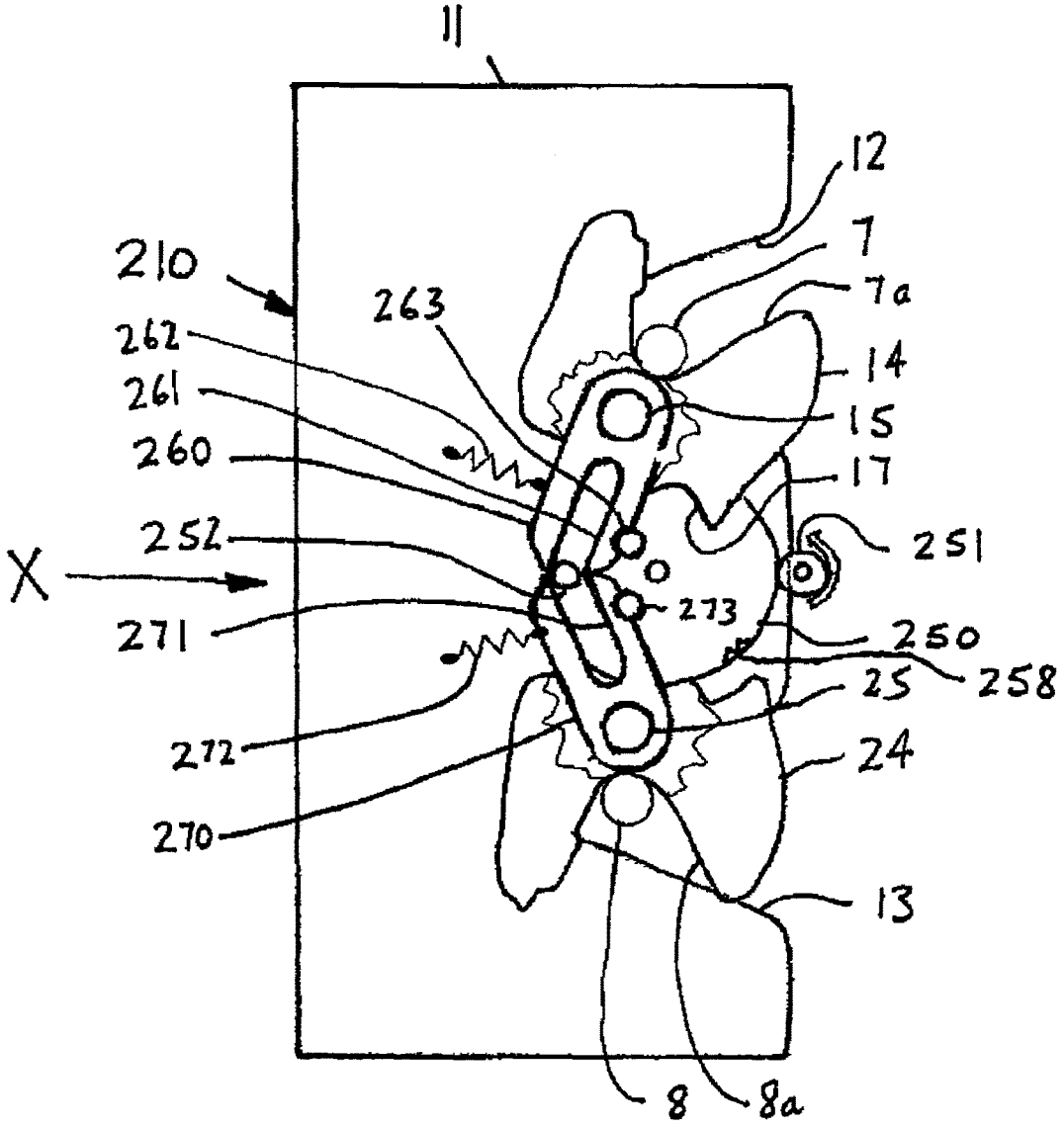
FIG. 13 is a plan view of a second embodiment of a power cinch mechanism that is suitable for use with a double latching assembly according to the invention showing a first claw in a non-cinched position and a second claw in a cinched position.

A spring 262 is attached to the first arm 260 to bias the first arm 260 towards a neutral position as shown in FIG. 13 and a torsion spring (not shown) is, as previously described, attached directly to the first claw 14 to bias it towards the unlatched position.

A spring 272 is attached to the second arm 270 to bias the second arm 270 towards the neutral position and a torsion spring (not shown) is attached directly to the second claw 24 to bias it towards the unlatched position.

The first arm 260 has a projection in the form of a drive pin 263 attached thereto for cooperation with a second abutment surface 17 formed on the first claw 14 and the second arm 270 has a drive pin 273 attached thereto for cooperation with a second abutment surface formed on the second claw 24.

In FIGS. 13 to 16 the second claw 24 has already been cinched by the cinch mechanism into its fully closed position but it will be appreciated that the cinch mechanism works in a similar manner to cinch the second claw 24 as will now be described with respect to the first claw with the exception that the drive wheel 250 is rotated in the opposite direction.

Figure 15:
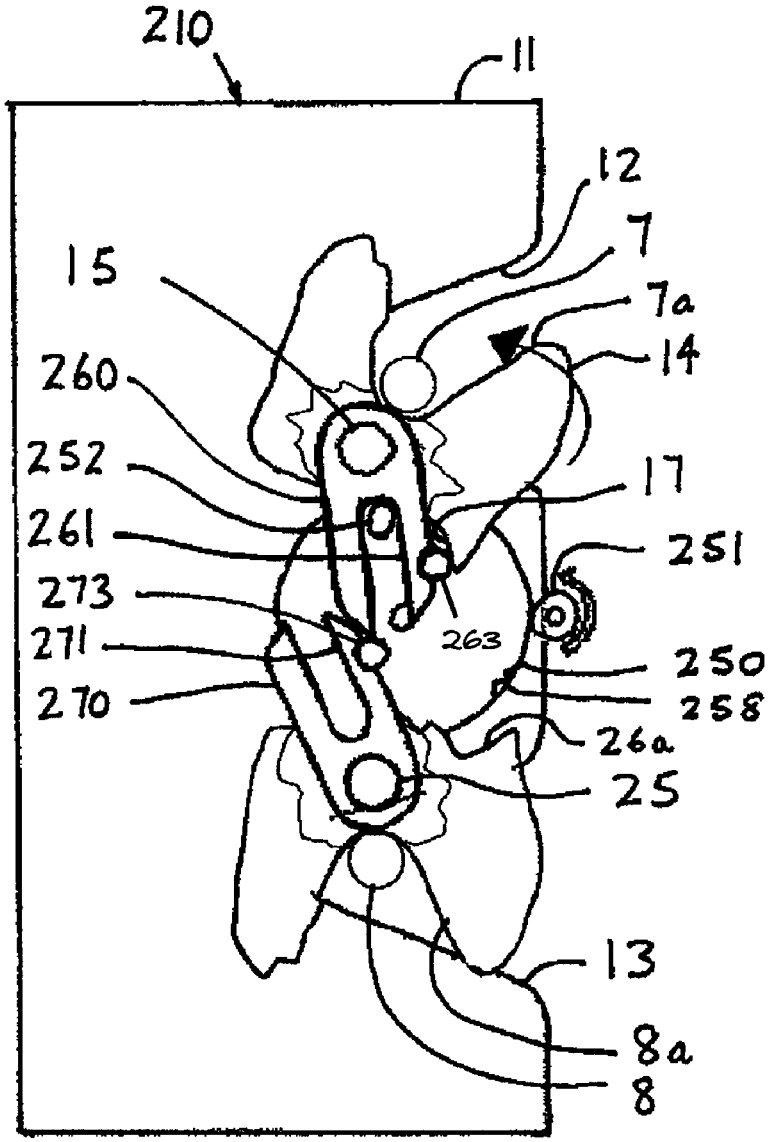
FIG. 15 is a view similar to FIG. 13 but showing the first claw in a partially cinched position.
Figure 16:
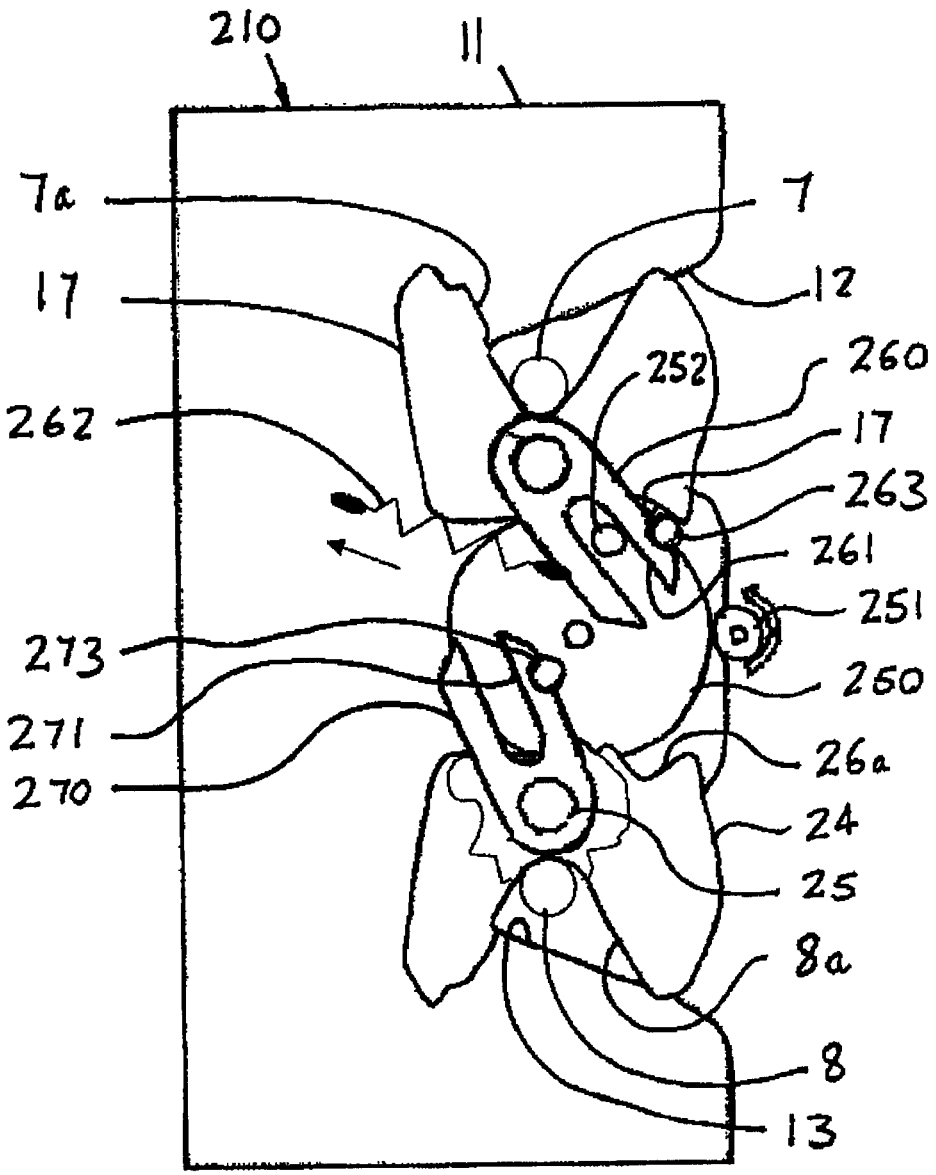
FIG. 16 is a view similar to FIG. 13 but showing the first claw in a fully cinched position.

Continuing now with the power cinching of the first claw 14, from the latched position shown in FIG. 13, to cinch the first claw 14 the actuator is energised so as to cause the drive wheel 250 to be rotated by the gearwheel 251 in a clockwise direction. This will cause the first arm 260 to be rotated in an anticlockwise direction due to the engagement of the drive pin 252 with the elongate slot 261 in the first arm 260 until, as shown in FIG. 15 the drive pin 263 contacts the second abutment surface 17 on the first claw 14. The continued rotation of the drive wheel 250 in a clockwise direction will then cause the first claw 14 to be rotated in an anticlockwise direction due to the interaction of the drive pin 263 with the second abutment surface 17 until the first claw 14 reaches its cinched position corresponding to a fully closed position of the upper tailgate 2. The fully closed position can be sensed by monitoring the power consumption of the actuator or by means of a sensor such as a microswitch.

After the first claw 14 is cinched the drive wheel 250 is rotated in an opposite direction to move the first arm 260 back to its resting position.

The first and second claws 14 and 24 are held in their respective cinched or fully locked positions by suitable retaining means which may be automatically released by the first and second pawls when the tailgates 2, 4 are unlatched or may be released by other means.

One of the advantages of using a power cinch mechanism for a door or tailgate having a power closing mechanism is that the power cinch mechanism can have a high mechanical advantage because the total distance that the door or tailgate has to move from its latched to its cinched positions is very small thereby permitting the use of a low power actuator whereas the mechanism used to close the door or tailgate has to move these a large distance and so normally has a lower mechanical advantage.

Although as described above and shown in the accompanying drawing the first closure member is an upper tailgate member arranged for rotation about a horizontally disposed pivot axis and the second closure member is a lower tailgate member arranged for rotation about pivot axis aligned parallel to the pivot axis of the upper tailgate member it will be appreciated that the invention is not limited to the latching and cinching of tailgates and that, for example, the first closure member could be a first door arranged for rotation about a vertically disposed pivot axis and the second closure member could be a second door arranged for rotation about pivot axis aligned parallel to the pivot axis of the first door. In which case, two double latch assemblies could be used to latch the first and second doors, one located adjacent to respective top edges of the first and second doors and one located adjacent to respective bottom edges of the first and second doors.

Therefore in summary, the mechanical design of doors usually requires the doors to be opened and closed in sequence and the use of a double latch allows release mechanisms for two doors or tailgates to be combined using a common motor, pneumatic, hydraulic or manual actuator and be simply configured to release the two doors in the required sequence.

A double latch allows power cinch to be applied to both doors using a common motor, a pneumatic actuator or a hydraulic actuator.

A double latch can be packaged inside the body structure allowing the door sections and general door package to be reduced and the aperture size to be increased.

A double latch designed in accordance with this invention would eliminate the need for additional wedges or buffers to secure or align the door.

A power cinch enables automatic power closing of the doors or tailgates via powered hinges or an independent actuator on each door/tailgate.

It will be appreciated by those skilled in the art that although the invention has been described by way of example with reference to one or more embodiments it is not limited to the disclosed embodiments and that one or more modifications to the disclosed embodiments or alternative embodiments could be constructed without departing from the scope of the invention.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A double latch assembly for a motor vehicle, the motor vehicle having first and second hinged closure members each of which has a latch member for cooperation with a double latch assembly to hold the respective closure member in at least a first latched position and a second fully latched position, the double latch assembly comprising:

a first rotatable claw for cooperation with the latch member of the first closure member to selectively hold the first closure member in one of the first latched position and the second fully latched position, a first drive arm for engagement with the first claw and to thereby effect movement of the first claw;

a second rotatable claw for cooperation with the latch member of the second closure member to selectively hold the second closure member in one of the first latched position and the second fully latched position;

a second drive arm for engagement with the first claw and to thereby effect movement of the first claw; and a power cinch mechanism engaged with the first and second drive arms, wherein the power cinch mechanism includes a single actuator connected to a drive wheel, wherein rotation of the drive wheel effects rotation of the first and second drive arms thereby moving the first and second closure members from the first latched positions to the second fully latched positions respectively, thereby ensuring the first and second closure members are fully closed when moved to the second fully latched positions.

2. The double latch assembly as claimed in claim 1 wherein the first drive arm includes a longitudinal slot formed therein driveably connected to the first claw, and the second drive arm includes a longitudinal slot formed therein driveably connected to the second claw, the cinch mechanism including a drive pin fastened to the drive wheel for engagement with the respective slots in the first and second drive arms such that rotation of the drive wheel in one direction cause the first arm to rotate the first claw to its second fully latched position and rotation of the drive wheel in an opposite direction cause the second arm to rotate the second claw to its second fully latched position.

3. A double latch assembly as claimed in claim 1 wherein the first closure member is a first tailgate door arranged for rotation about a horizontally disposed pivot axis and the second closure member is a second tailgate door arranged for rotation about pivot axis aligned parallel to the pivot axis of the first tailgate door.

4. A double latch assembly as claimed in claim 3 wherein two double latch assemblies are used to latch the first and second tailgate doors, one located adjacent to respective top edges of the first and second doors and one located adjacent to respective bottom edges of the first and second tailgate doors.

5. A double latch assembly as claimed in claim 4 wherein two double latch assemblies are used to latch the first and second tailgate doors one located adjacent to respective left-hand edges of the first and second tailgate doors and one located adjacent to respective right-hand edges of the first and second tailgate doors.

6. A double latch assembly for a motor vehicle, the vehicle having first and second hinged closure members, each of the closure members having a latch member for cooperation with the double latch assembly to hold the respective closure member in at least a first latched position and a second latched position, the double latch assembly comprising:

a first rotatable claw for cooperation with the latch member of the first closure member to selectively hold the first closure member in one of first latched position and the second latched position;

a first pawl for engagement with a first surface on the first claw so as to hold the first claw in a first position corresponding to the first latched position of the first closure member;

a second rotatable claw for cooperation with the latch member of the second closure member to selectively hold the second closure member in one of the first latched position and the second latched position;

a second pawl for engagement with a first surface on the second claw so as to hold the second claw in a first position corresponding to the first latched position of the second closure member; and a power cinch mechanism wherein the power cinch mechanism comprises a drive wheel drivingly connected to a single actuator and two drive mechanisms driven by the drive wheel to effect rotation of the first and second claws from their first latched positions to second positions corresponding to respective second latched positions thereby ensuring the first and second closure members are fully closed when moved to the second latched position.

7. The double latch assembly as claimed in claim 6 wherein the first pawl includes a first arm having a longitudinal slot formed therein driveably connected to the first claw, and the second pawl includes a second arm having a longitudinal slot formed therein driveably connected to the second claw, the power cinch mechanism including a drive pin fastened to the drive wheel for engagement with the respective slots in the first and second arms such that rotation of the drive wheel in one direction cause the first arm to rotate the first claw to its second position and rotation of the drive wheel in an opposite direction cause the second arm to rotate the second claw to its second latched position.

8. A double latch assembly as claimed in claim 6 wherein the first closure member is a first tailgate member arranged for rotation about a horizontally disposed pivot axis and the second closure member is a second tailgate member arranged for rotation about pivot axis aligned parallel to the pivot axis of the first tailgate member.

9. A double latch assembly for a motor vehicle, the vehicle having first and second closure members movable between at least an open position and a latched position, each of the closure members having a latch member for cooperation with the double latch assembly to hold the respective closure member in the latched position, the double latch assembly comprising:

a first rotatable claw for cooperation with the latch member of the first closure member to selectively hold the first closure member in the latched position, a first pawl for engagement with a first surface on the first claw so as to hold the first claw in a first position corresponding to the latched position of the first closure member, a second rotatable claw for cooperation with the latch member of the second closure member to selectively hold the second closure member in the latched position, a second pawl for engagement with a first surface on the second claw so as to hold the second claw in a first position corresponding to the latched position of the second closure member, a power cinch mechanism engaged with the first and second pawls, wherein the power cinch mechanism includes a single actuator connected to a drive wheel, wherein rotation of the drive wheel effects rotation of the first and second pawls to effect movement each of the first and second closure members from the latched position to a second fully latched position, respectively, thereby ensuring the first and second closure members are fully closed when moved to the second fully latched position, respectively.

10. A double latch assembly as claimed in claim 9 further comprising:

a sequencing lever to selectively release the first and second pawls in a predetermined order, and a disengageable coupling is provided between the sequencing lever and the second pawl, the disengageable coupling arranged to mechanically enable the sequencing lever to control releasing of the first and second closure members such that the first closure member is always released to the open position before the second closure member can be released to the open position.

11. A double latch assembly as claimed in claim 10 wherein, when the disengageable coupling is disengaged, movement of the sequencing lever by the actuator release the first pawl without releasing the second pawl and, when the disengageable coupling is engaged, movement of the sequencing lever by the actuator disengage the second pawl.

12. A double latch assembly as claimed in claim 10 wherein the disengageable coupling is engaged by the first claw when the first claw is rotated from its first position by the opening of the first closure member.

13. The double latch assembly as claimed in claim 9 wherein the first pawl includes a first arm having a longitudinal slot formed therein driveably connected to the first claw, and the second pawl includes a second arm having a longitudinal slot formed therein driveably connected to the second claw, the cinch mechanism including a drive pin fastened to the drive wheel for engagement with the respective slots in the first and second arms such that rotation of the drive wheel in one direction cause the first arm to rotate the first claw to its second position and rotation of the drive wheel in an opposite direction cause the second arm to rotate the second claw to its second position.

14. A double latch assembly as claimed in claim 9 wherein the first closure member is a first tailgate member arranged for rotation about a horizontally disposed pivot axis and the second closure member is a second tailgate member arranged for rotation about pivot axis aligned parallel to the pivot axis of the first tailgate member.

* * * * *